US005165456A

United States Patent [19]

Woolman

[11] Patent Number: 5,165,456

[45] Date of Patent: Nov. 24, 1992

[54] DIVERTER APPARATUS AND METHOD FOR SAVING FRESH WATER

[76] Inventor: Richard F. Woolman, 1736 Shipley La., Huntington Beach, Calif. 92648

[21] Appl. No.: 685,733

[22] Filed: Apr. 16, 1991

[51] Int. Cl.[5] ..... A47K 4/00

[52] U.S. Cl. ..... 141/98; 4/597; 4/625

[58] Field of Search ..... 4/191, 192, 567, 596, 4/597, 602, 603, 605, 612, 613, 625, 626, 654, 661; 141/98, 346, 349, 388, 18; 137/511, 455, 468; 285/33; 126/344

[56] References Cited

U.S. PATENT DOCUMENTS

| | | | |
|---|---|---|---|
| 3,461,870 | 8/1969 | Van Linge | 4/596 X |
| 3,545,426 | 12/1970 | Escaldi | 126/344 |
| 3,594,825 | 7/1971 | Reid | 4/663 |
| 3,750,196 | 8/1973 | Halferty | 4/625 |
| 3,847,159 | 11/1974 | Hofer | 4/605 X |
| 3,913,839 | 10/1975 | Wilson | 4/597 |
| 4,030,144 | 6/1977 | Aleman | 4/665 |
| 4,150,445 | 4/1979 | Bailey | 4/567 X |
| 4,197,597 | 4/1980 | Toms | 4/300 |
| 4,358,864 | 11/1982 | Medrano | 4/665 |
| 4,432,105 | 2/1984 | Pitroda | 4/597 |
| 4,527,543 | 7/1985 | Denton | 126/344 X |
| 4,554,688 | 11/1985 | Puccerella | 4/191 |
| 4,654,900 | 4/1987 | McGhee | 4/191 |
| 4,854,499 | 8/1989 | Neuman | 4/192 X |
| 4,893,364 | 1/1990 | Keeler | 4/597 |
| 4,901,927 | 2/1990 | Valdivia | 4/596 |
| 5,027,447 | 7/1991 | Pino | 4/661 X |
| 5,065,463 | 11/1991 | Le | 4/567 X |

FOREIGN PATENT DOCUMENTS

| | | | |
|---|---|---|---|
| 1484897 | 12/1968 | Fed. Rep. of Germany | 4/192 |
| 3723089 | 1/1989 | Fed. Rep. of Germany | 4/192 |
| 1472629 | 10/1967 | France | 4/596 |
| 0630966 | 12/1961 | Italy | 4/597 |
| 0089245 | 5/1957 | Norway | 4/192 |
| 0330421 | 6/1930 | United Kingdom | 4/597 |

*Primary Examiner*—Henry J. Recla
*Assistant Examiner*—Casey Jacyna
*Attorney, Agent, or Firm*—Francis X. LoJacono

[57] ABSTRACT

A diverter apparatus and method of saving fresh water from being wasted while one waits for the cold or lukewarm water that accumulates in a hot-water pipeline to pass therethrough before the usable hot water begins discharging from a shower fixture or from a faucet fixture. The apparatus comprises a two-way diverter valve having an inlet port and two outlet ports. The inlet port is attached to the shower or faucet discharge fixture whereby the fresh water can be diverted to one of the outlet ports which is connected to one end of a hose. The hose is interconnected between the diverter valve and a storage container so that the initial cold water passes through the hose for storage in the container until hot water is discharged whereby the cold water is prevented from being wasted down a drain. The other outlet port of the diverter valve is adapted to receive a shower-head fixture or a faucet-aerator fixture.

21 Claims, 2 Drawing Sheets

DIVERTER APPARATUS AND METHOD FOR SAVING FRESH WATER

BACKGROUND OF THE INVENTION

FIELD OF THE INVENTION

The present invention relates to a means for saving water and more particularly to a diverter apparatus and method of saving fresh water that is used for human consumption, such as for drinking, bathing, showering, washing clothes, flushing toilets, shaving, etc.

As is well known in many countries throughout the world today there exists a very serious water shortage which is primarily due to the lack of sufficient rainfall. Drought conditions are at present being felt in many southern, midwestern and western regions of the United States, and more particularly in the central and southern sections of the State of California where the worst drought on record is in its fifth year. Mandatory conservation measures have been adopted in most of the major cities requiring a 20% or more reduction in water consumption. And if not adhered to, consumers will face various penalties for using more than their designated allotments.

There is one area of water use that creates a great deal of fresh water waste of between 3 to 5 gallons and that waste occurs during the lag time between when a hot water faucet is turned on at the shower or sink and when the actual warm or hot water is effectively delivered for use. This problem often occurs when there is a great distance between the hot water heater and the faucet being used. The long distance that hot water has to travel from the hot water heater to an outlet, such as a shower head or faucet, will determine the amount of unusable cool or cold water that accumulates in the delivery pipes during a given time period. There is also water wasted during the mixing time of the hot and cold waters. All of the initial flow of fresh water is at present lost down the drain. However, it has been known for individuals to place an open bucket in the bath tub or stall shower to catch the initial flow of cold water.

SUMMARY AND OBJECTS OF THE INVENTION

The present invention discloses a novel method and arrangement of combining a variety of plumbing fixtures that, when used together as a unit define a water-flow-diverter apparatus for solving a prevailing problem that occurs when fresh usable water is wasted while one waits for the initial accumulated fresh cold or lukewarm water in a hot water pipeline to pass before the discharging water is hot enough for use.

The present invention is defined as a fresh-water saving apparatus that is adapted for use with various water outlets and more particularly in conjunction with faucets and shower fixtures.

Accordingly, an important object of the invention is to attach to a typical faucet spout or shower arm a water-diverter apparatus that comprises a two-way diverter valve that includes two outlets, one of the outlets being connected to an elongated conduit or flexible hose, and the other outlet being formed to receive a shower head when the apparatus is to be mounted to a shower or an aerator head to be used in combination with a suitable faucet as is generally found mounted on kitchen or bathroom sinks.

Another object of the invention is to provide a diverter apparatus wherein one end of the hose is adapted to be removably connected to an enclosed container, more preferably a collapsible container having at least a one-gallon capacity, and wherein the container includes a dispensing spout, whereby the container may be used for selective discharging of the fresh water stored therein.

Still another object of the invention is to provide an apparatus of this character that is easy to install on the average shower-arm member or sink-type faucet having an aerator cap.

It is still another object of the present invention to provide a diverter apparatus wherein no special installation tools are required.

A further object of the invention is to provide an apparatus of this character that is simple to operate and easy to maintain, and wherein there is provided a quick-disconnect coupling device between the hose and the water-storage container.

A still further object of the invention is to provide a two-way diverter apparatus of this character that is easy to assemble for use and wherein the water storage container is readily removable from a stall-shower enclosure or a sink area when the container of the apparatus is disconnected. The saved water would be clean and safe to use from the container for human consumption such as for drinking, cooking, etc., or any other suitable use where fresh clean water is required.

Still a further object of the invention is to provide an apparatus of this type that is relatively inexpensive to manufacture, and is simple yet rugged in construction.

The various features of novelty which characterize the invention are pointed out with particularity in the claims annexed to and forming a part of this disclosure. For a better understanding of the invention, its operating advantages by its use, reference should be had to the accompanying drawings and descriptive matter in which there are illustrated and described the preferred embodiments of the invention.

BRIEF DESCRIPTION OF THE DRAWINGS

With the above and related objects in view, the invention consists in the details of construction and combination of parts, as will be more fully understood from the following description, when read in conjunction with the accompanying drawings and numbered parts, in which.

DESCRIPTION OF THE PREFERRED EMBODIMENT

Figure 1:
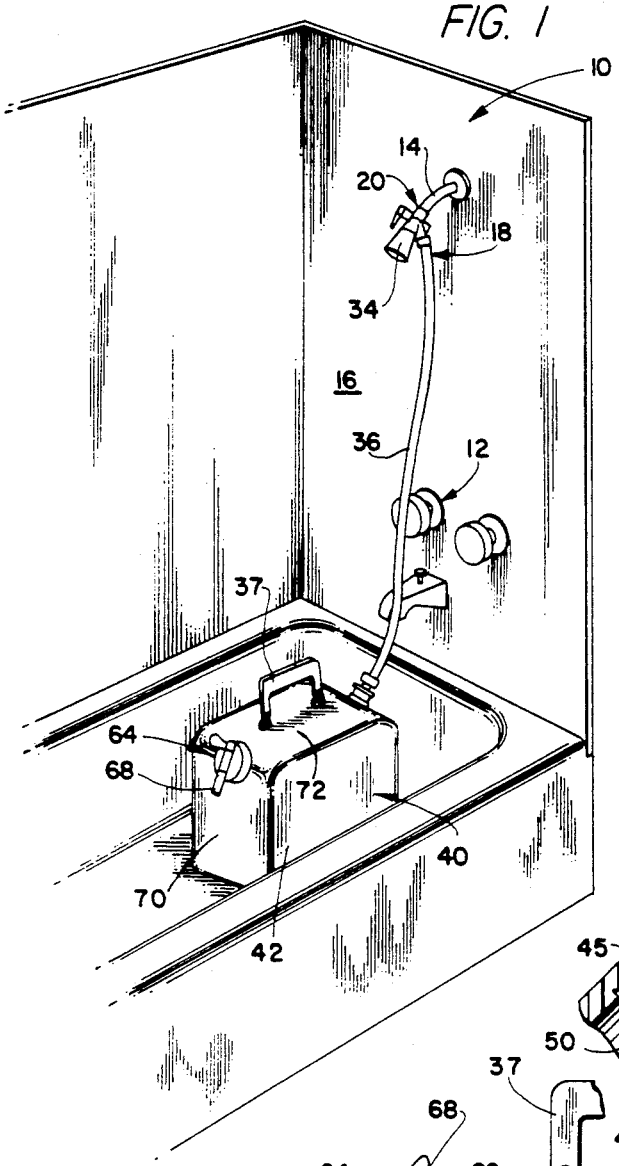
FIG. 1 is a pictorial view of the present invention defined by a water-saving-diverter apparatus, which is illustrated connected to a shower arm whereby water may be diverted to either the shower tub or to the storage container.

Referring more particularly to FIG. 1, there is illustrated a pictorial view of a shower stall, generally indicated at 10, having typical plumping and shower fixtures, designated at 12, including a shower arm or outlet neck 14, wherein a fresh-water-discharging means is defined. Connected to outlet neck 14, which extends outwardly from wall 16 of the shower, is a water-diverter apparatus that is indicated generally at 18.

Figure 2:
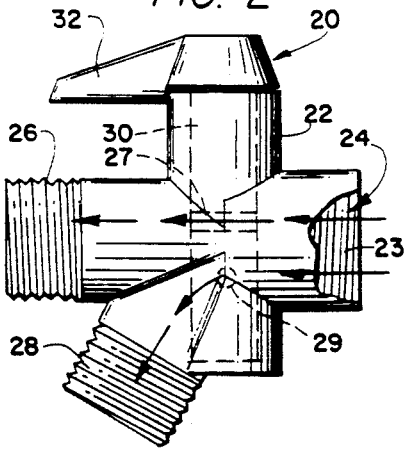
FIG. 2 is an enlarged view of a two-way diverter valve that is formed having an inlet port and two outlet ports.
Figure 4:
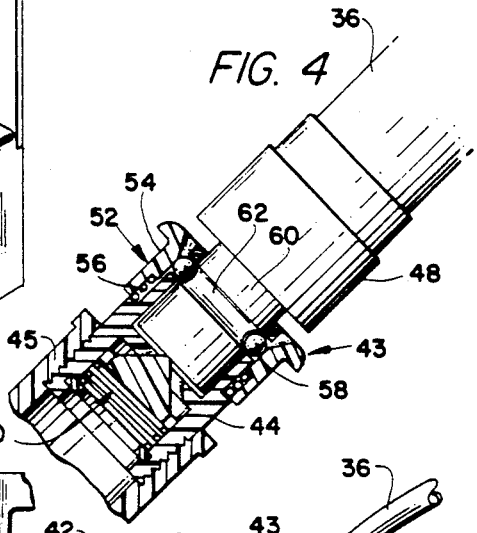
FIG. 4 is an enlarged cross-sectional view of a one-way quick disconnect valve that is mounted in the inlet port of the storage container.
Figure 3:
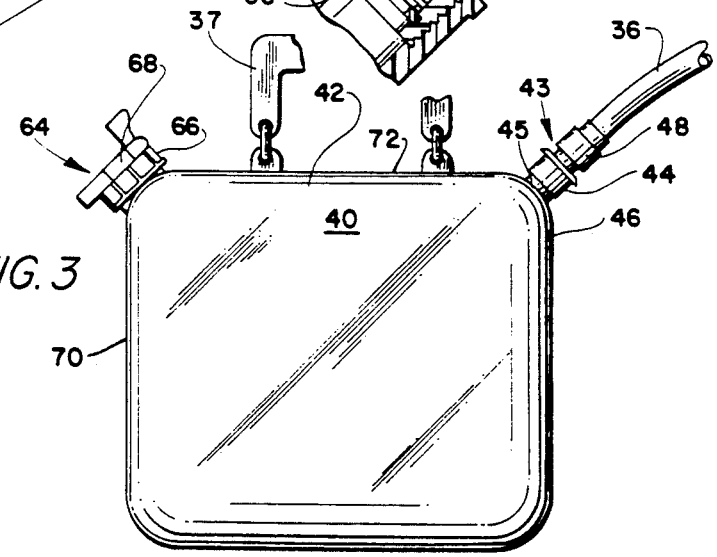
FIG. 3 is a side-elevational view of the storage container with a portion of the diverter hose connected to the inlet port of the container.

Water-diverter apparatus comprises a two-way diverter valve 20 having a valve body 22 which is formed having an inlet port 24, and a first outlet port 26 and a second outlet port 28. The inlet port 24 is separated from the two outlet ports 26 and 28 by means of a rotatable valve stem 30 which is provided with a knob 32 for rotating said valve stem 45 degrees so as to selectively divert the fresh water from outlet neck 14 to either the first outlet port 26 or the second outlet port 28 by way of respective valve passages 27 and 29. (See FIG. 2.) The typical shower arm 14 is formed having a threaded male connector end to which a shower head 34 is commonly attached. However, when diverter valve 20 is to be installed, shower head 34 is removed from shower arm 14 and is replaced by diverter valve 20. Accordingly, inlet port 24 defines the female end of the valve body 22 which is provided with internal threads 23, as illustrated in FIG. 2. Shower head 34 is then attached to the externally threaded outlet port 26, as shown in FIG. 1. A suitable length of tubing or hose 36 is connected to the externally threaded second outlet port 28 by means of a threaded coupling member 38 which is rotatably mounted to one end of hose 36. Hose 36 is then attached to a storage means, generally designated at 40, said storage means being preferably defined by a collapsible container or tank 42 formed from suitable plastic. However, any suitable container may be employed. Hose 36 is attached to container 42 by a suitable quick-disconnect means 43 that includes a female connector member 44 and a male connector member 48, which is more clearly shown in FIG. 4. The female connector member 44 is mounted to an extended neck member 45 that is formed in end wall 46 of the storage container 42 adjacent the upper end thereof, wherein female connector 44 and neck member 45 define a water-receiving means for container 42. The male connector member 48 is mounted to the opposite disconnect end of hose or tube 36. The female connector member is provided with a one-way valve means, indicated generally at 50, and includes a spring-loaded coupling means, designated at 52, which is defined by a slidable ring member 54 that is biased by spring 56 to support locking pins or balls 58. Correspondingly, male connector member 48 is adapted with an extended neck member 60 having a locking groove 62 formed therein to receive balls 58. Again, any sutiable quick-disconnect means may be used.

Container 42 is provided with a threaded port on which is mounted a dispensing means defined by spout 64 comprising a screw cap 66 having a dispensing spout or spigot 68. Spout means 64 is mounted adjacent the top of side wall 70 container 42. It should be noted that dispensing spout or spigot 68 is positioned in an open mode when either dispensing water or when container 42 is receiving water through hose 36. A handle 37 is also attached to the top surface 72, whereby a full tank can be readily lifted when needed.

Figure 5:
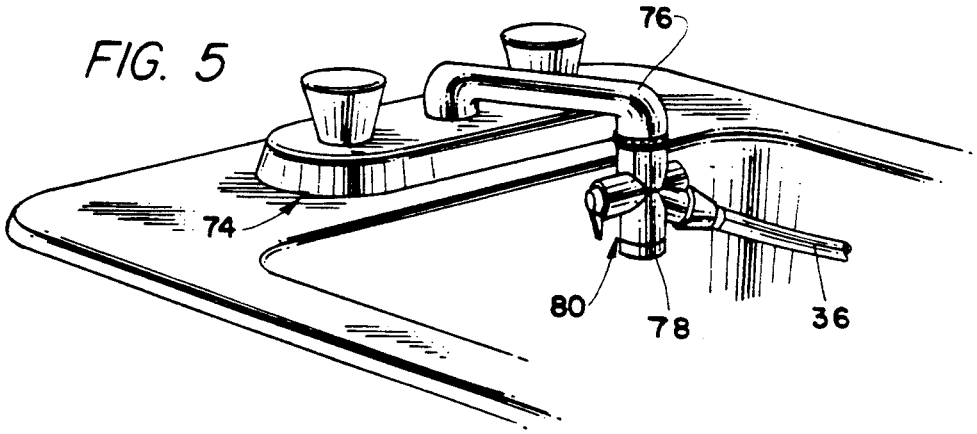
FIG. 5 is a pictorial view of a sink-type faucet having a diverter valve mounted thereon.
Figure 6:
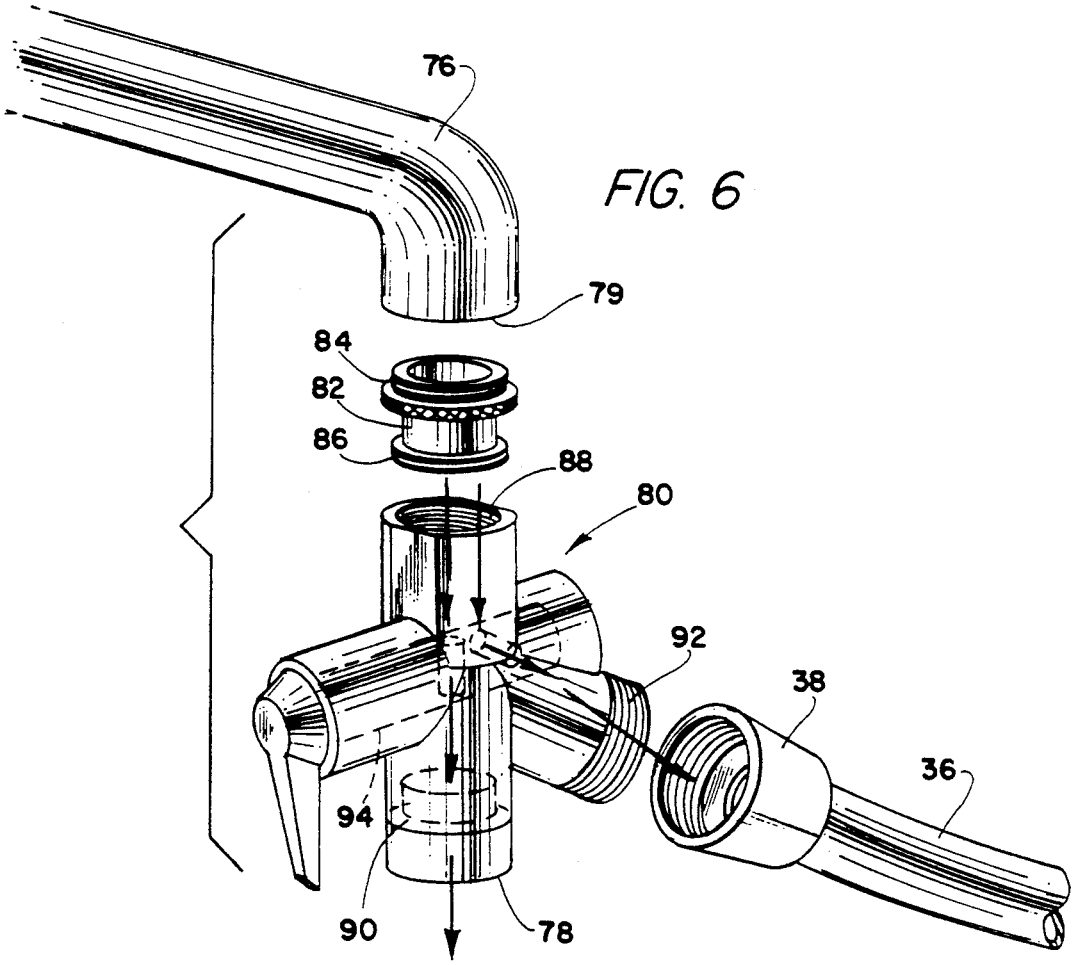
FIG. 6 is an exploded perspective view of the faucet spout, the diverter valve, and an interconnecting member positioned therebetween.

Referring now to the embodiment as illustrated in FIGS. 5 and 6, there is shown a sink faucet 74 that is mounted on a sink. Faucet 74 is formed having a spout 76 that defines a water-discharge means, wherein an aerator member 78, which is normally mounted to outlet 79 of spout 76, is removed from outlet 79 so as to be attached to the outlet port 90 of diverter valve 80, that is, if outlet port 90 is not already provided with one. Diverter valve 80 is then attached to outlet port 79 of spout 76 in place of the aerator member 78 by an intermediate connector means defined by a dual-threaded insert member 82 that is formed having two threaded ends 84 and 86. Threaded end 84 is adapted to be threadably received in outlet 79 of spout 76, and the opposite threaded end 86 is adapted to be threadably received in inlet port 88 of diverter valve 80. Diverter valve 80 is formed having a first outlet port 90 and a second outlet port 92, said first outlet port being threadably adapted to receive aerator 78, and second outlet port being adapted to be threadably received in coupling member 38 of hose 36. The valve stem 94 of valve 80 is also arranged so as to divert fresh water from spout 76 to flow through either aerator 78 into the sink or through hose 36 into container 42.

It may thus be seen that the objects of the present invention set forth herein, as well as those made apparent from the foregoing description, are efficiently attained. While preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What I claim is:

1. A diverter-valve apparatus for recovering fresh waste water from a fresh-water-discharging means, wherein said diverter-valve apparatus comprises in combination:

a manually operated diverter valve having an inlet port and first and second outlet ports through which water is selectively discharged from one of said outlet ports, and wherein said inlet port is mounted to a fresh water-discharging means;

a portable holding tank having a top portion and an inlet neck formed in one side of said top portion of said portable holding tank to receive fresh water from said diverter valve, and an outlet neck formed in the top portion of said portable holding tank on the opposite side from that of said inlet neck, said portable holding tank being located downstream of said diverter valve;

a controlled dispensing means mounted on said outlet neck of said storage container; and a hose removably connected between said diverter valve and said inlet neck of said storage container, said hose including at least one coupling nut mounted to one end of said hose, whereby said hose is coupled to said second outlet port of said diverter valve.

2. The combination as recited in claim 1, including a quick-disconnect means interposed between said inlet neck of said holding tank and one end of said hose.

3. The combination as recited in claim 2, wherein said quick-disconnect means comprises:

a female disconnect member secured in said inlet neck of said holding tank; and a male disconnect member attached to one end of said hose, whereby said hose is removable from said holding tank when said container is filled with fresh waste water diverted from the discharge means.

4. The combination as recited in claim 3, wherein said female disconnect member includes a one-way valve means, whereby water stored in said holding tank can not be dispensed from said inlet neck when said male disconnect member is removed from said female disconnect member.

5. The combination as recited in claim 4, wherein said dispensing means is defined by a cap member having a spigot member, whereby water is dispensed from said spigot as needed.

6. The combination as recited in claim 5, wherein said diverter valve includes a two-way flow-valve stem, whereby water is selectively diverted from flowing through said first outlet port so as to flow through said second outlet port, whereby a selective amount of fresh water is diverted into said portable holding tank for storage.

7. The combination as recited in claim 6, wherein said holding tank is formed from a collapsible plastic material.

8. The combination as recited in claim 6, wherein said first and second outlet ports are formed having external threads.

9. The combination as recited in claim 6, wherein said first outlet port is formed having internal threads and said second outlet port is formed having external threads.

10. A method of saving a given amount of the initial flow of fresh water from a water-discharging means comprising the steps of:

connecting a manually operated diverter valve to a fresh hot-water-discharging means;

connecting one end of a hose to said diverter valve;

connecting the opposite end of said hose to a storage container located downstream of said diverter valve;

running the fresh water through said hot-water-discharging means; and manually operating said diverter valve to divert the initial flow of cold fresh water from said hot water-discharge means to said storage container for storage therein.

11. A method as recited in claim 10, wherein said diverter valve is defined as a two-way diverter valve having an inlet port, and a first outlet port and a second outlet port; and including the steps of:

attaching said inlet port to said hot-water-discharging means;

attaching one end of said hose to said second outlet port;

removably connecting the opposite end of said hose to said storage container;

adjusting said diverter valve so as to direct the flow of water through said second outlet port prior to discharging water from said hot-water-discharging means, whereby the the initial flow of fresh water is diverted to said storage container; and adjusting said diverter valve to direct the fresh hot water through said first outlet port after hot water begins to flow from said hot-water-discharging means.

12. A method as recited in claim 11 including the step of attaching a shower head to said first outlet of said diverter valve.

13. A method as recited in claim 11 including the step of attaching an aerator to said first outlet of said diverter valve.

14. A method as recited in claim 11, wherein said storage container and said hose include a quick-disconnect means mounted therebetween.

15. A method as recited in claim 11, wherein said storage container includes a dispensing means.

16. A method as recited in claim 11, wherein said hot-water discharging means defines an outlet neck that is attached to said inlet port of said diverter valve.

17. A method as recited in claim 16, wherein said outlet neck is defined by a shower arm.

18. A method as recited in claim 16, wherein said outlet neck is defined by a faucet spout.

19. A diverter-valve apparatus for recovering fresh waste water from a fresh-water-discharging means, wherein said diverter-valve apparatus comprises in combination:

a storage container formed from a collapsible plastic material having an inlet neck formed in one side of said storage container to receive fresh water, and an outlet neck formed in said storage container on the opposite side from that of said inlet neck;

a diverter valve having an inlet port and first and second outlet ports through which water is selectively discharged from one of said outlet ports, said inlet port being mounted to a fresh water-discharging means, wherein said diverter valve includes a two-way flow-valve stem, whereby water is selectively diverted from flowing through said first outlet port so as to flow through said second outlet port into said inlet neck of said storage container whereby a selective amount of fresh water is diverted into said container for storage;

dispensing means mounted on said outlet neck of said storage container and defined by a cap member having a spigot member, whereby water is dispensed from said spigot as needed;

a hose removably connected between said diverter valve and said inlet neck of said storage container, said hose including at least one coupling nut mount to one end of said hose, whereby said hose is coupled to said second outlet port of said diverter valve;

a quick-disconnect means interposed between said inlet neck of said container and one end of said hose, wherein said quick-disconnect means comprises:

a female disconnect member secured in said inlet neck of said container;

a male disconnect member attached to one end of said hose, whereby said hose is removable from said container when said container is filled with fresh waste water diverted from the discharge means, and wherein said female disconnect member includes a one-way valve means, whereby water stored in said container can not be dispensed from said inlet neck when said male disconnect member is removed from said female disconnect member.

20. The combination as recited in claim 19, including a handle mounted to said container.

21. The combination as recited in claim 19, including a dual threaded insert member for attaching said diverter valve to the fresh water-discharging means.

* * * * *